US009717378B2

(12) United States Patent
Cittadino

(10) Patent No.: US 9,717,378 B2
(45) Date of Patent: Aug. 1, 2017

(54) SHEET DISPENSER ROLL HOLDER WITH LOCKOUT FEATURE(S)

(71) Applicant: Georgia-Pacific Consumer Products LP, Atlanta, GA (US)

(72) Inventor: Antonio Michael Cittadino, Appleton, WI (US)

(73) Assignee: GEORGIA-PACIFIC CONSUMER PRODUCTS LP, Atlanta, GA (US)

( * ) Notice: Subject to any disclaimer, the term of this patent is extended or adjusted under 35 U.S.C. 154(b) by 612 days.

(21) Appl. No.: 14/038,425

(22) Filed: Sep. 26, 2013

(65) Prior Publication Data

US 2015/0083847 A1 Mar. 26, 2015

(51) Int. Cl.

| | |
|---|---|
| ***A47K 10/38*** | (2006.01) |
| ***A47K 10/24*** | (2006.01) |
| ***A47K 10/22*** | (2006.01) |
| ***B65H 75/18*** | (2006.01) |
| ***A47K 10/40*** | (2006.01) |

(52) U.S. Cl.

CPC ..... *A47K 10/3836* (2013.01); *A47K 10/22* (2013.01); *A47K 10/24* (2013.01); *A47K 10/38* (2013.01); *A47K 10/40* (2013.01); *B65H 75/185* (2013.01)

(58) Field of Classification Search

CPC .... A47K 10/22; A47K 10/38; A47K 10/3836; A47K 10/40; B65H 75/185

See application file for complete search history.

(56) References Cited

U.S. PATENT DOCUMENTS

| | | | | |
|---|---|---|---|---|
| 6,874,958 | B1 * | 4/2005 | Panebianco | B41J 15/02 242/358.1 |
| 7,364,112 | B1 * | 4/2008 | Formon | A47K 10/3836 242/564.1 |
| 2009/0001213 | A1 * | 1/2009 | Looft | A61L 9/12 242/599 |
| 2011/0210198 | A1 * | 9/2011 | Case | A47K 10/38 242/598 |
| 2012/0138723 | A1 | 6/2012 | Lewis et al. | |

FOREIGN PATENT DOCUMENTS

| | | | | |
|---|---|---|---|---|
| GB | 194797 A | * | 3/1923 | A47K 10/40 |

* cited by examiner

*Primary Examiner* — Luis A Gonzalez

(74) *Attorney, Agent, or Firm* — Cantor Colburn LLP

(57) ABSTRACT

Embodiments of a roll support, and a roll support system, for a sheet product dispenser are disclosed. One such roll support includes an arm having an end portion and an aperture proximate the end portion of the arm and recessed therein. The aperture includes a capture region and a release region. The capture region has a width dimensioned to receive a matching end cap and shaped to allow the matching end cap to rotate freely within the capture region. The release region is contiguous with the capture region and has a width less than the width of the capture region.

6 Claims, 6 Drawing Sheets

SHEET DISPENSER ROLL HOLDER WITH LOCKOUT FEATURE(S)

BACKGROUND

Sheet dispensers are often employed to dispense sheet products wound on a roll, such as paper towels and tissue, in common areas such as public washrooms. The cost of such dispensers is relatively high, and often these dispensers are provided at a discounted rate. Unless specifically provided for, a given dispenser may be suitable for many different varieties of sheet products, even those produced by different manufacturers. Under these conditions, the risk exists that the products offered in a dispenser may be those of a competitor. Separate from this commercial risk is the risk that products not designed specifically for a dispenser may impair operation of the dispenser. Therefore, "captive" systems of cooperating dispensers and sheet product rolls have been developed. Such captive systems accept specific types of sheet product rolls. One type of captive system involves a specially shaped end cap which fits into the core of the roll and also interacts in a complementary way with the roll supports inside the dispenser. Without the appropriate end cap, a roll cannot be inserted or dispenser does not function correctly.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure.

DETAILED DESCRIPTION

Described herein are embodiments of a roll support system for use in a sheet product dispenser, in which an arm configured to support a sheet product roll cooperates with an end cap, thereby excluding other end caps from use with the arm. The arm includes one or more lockout features that allow the arm to rotatably support a sheet product roll having a particular set of end caps, while preventing the arm from rotatably supporting other end caps. More specifically, some embodiments of the arm have an aperture that includes a capture region and a contiguous release region. The release region is sized smaller than the capture region so that some end caps can enter the capture region of the aperture and yet fall into the release region, thus preventing rotation of the sheet product roll within the aperture. Some embodiments of the arm have a protrusion extending outward from the arm, with a guide channel formed within the protrusion. The end face of the protrusion is a ramped surface that slopes downward. A sheet product roll with no end cap, or with a non-matching end cap, does not enter the guide channel, and because of the slope, the sheet product roll is not supported by the arm and does not rotate about the arm.

Figure 1:
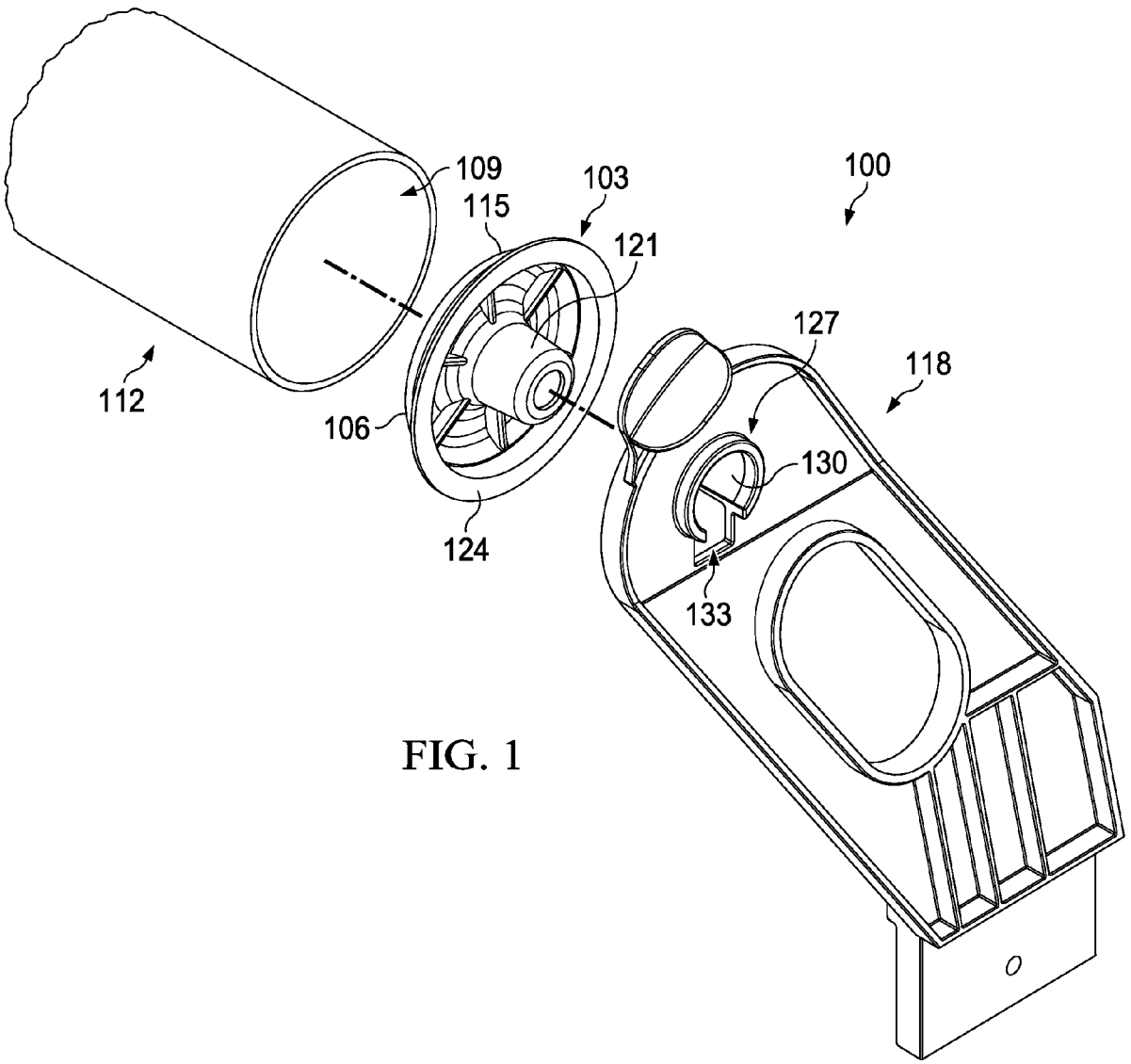
FIG. 1 is an isometric view of a roll support system for a sheet product dispenser, according to some embodiments disclosed herein.

FIG. 1 is an isometric view of a roll support system for a sheet product dispenser. The roll support system 100 includes an end cap 103 having an inner surface 106 that is received by a lumen 109 at one end of a sheet product roll 112. The inner surface 106 is shaped and sized to securely hold the end cap 103 within the lumen. In the example of FIG. 1, this is accomplished with by a flange 115 extending from the circumference of the inner surface 106, but other mechanisms for securing the end cap 103 within the lumen 109 are also possible. The lumen 109 is commonly referred to by those of ordinary skill in the art as the "core" of the roll 112, and will be generally referred to herein as the core 109. The end cap 103 is also referred to by those of ordinary skill in the art as a "plug" or a "core plug."

The roll support system 100 also includes an arm 118 that supports the sheet product roll 112. In the embodiments illustrated herein, the arm 118 is generally elongate and flattened; however, other shapes are contemplated. The arm 118 is positioned to allow the sheet product roll 112 to rotate about the arm 118. More specifically, a hub 121 extends from an outer surface 124 of the end cap 103 and is received by an aperture 127 disposed within the arm 118. The hub 121 is generally annular in shape, and the aperture 127 is shaped and sized to engage with the hub 121 such that the hub 121 freely rotates within the aperture 127. In the embodiment shown in FIG. 1, the aperture 127 is located near an end portion of the arm 118. However, the aperture 127 may occupy other locations along the arm 118, as long as the arm 118 supports the sheet product roll 112.

As noted above, the roll support system 100 operates with a sheet product dispenser. For example, the other end of the arm 118 is mounted to a dispenser housing, and the sheet product roll 112 and the arm 118 are both enclosed by the dispenser housing. The core at the other end of the sheet product roll 112 is supported by, and rotates about, another support arm. In some dispenser embodiments, the second support arm includes the same lockout features as the arm 118, and is thus is used with the same type of end cap 103. In other dispenser embodiments, the second support arm includes different lockout features, and is thus used with a different type of end cap. In still other dispenser embodiments, the second support arm does not use an end cap of any kind, and instead the sheet product roll 112 engages directly with a feature of the second support arm, for example, a boss or protrusion. Using a different roll support arm on each side allows the orientation of the sheet product roll 112 to be controlled, which may be desirable since some dispensers perform better with a sheet that feeds off the top of the roll 112 and others perform better with a sheet that feeds off the bottom of the roll 112.

The sheet product dispenser contains other components that are not necessary to understand the operation of the roll support system 100. Such components are therefore not illustrated herein and will not be discussed in detail. However, a brief overview of the operation of the sheet product dispenser will now be provided.

As noted above, a sheet product dispenser includes a supply of sheet product, which may be in roll form, such as sheet product roll. The sheet is dispensed from the roll by passing one end of the sheet through a pair of rollers. The rollers of some dispensers (commonly referred to as "manual" dispensers) are driven by the pull force of a user. In other dispensers (commonly referred to as "automatic" dispensers), one of the rollers is coupled to an electric motor that is selectively energized by a controller. In an automatic dispenser, friction between the rollers and the sheet product pulls the sheet product from the roll when the motor is operated. The controller may energize the motor when a proximity sensor detects a user interacting with the sensor, or when a tear sensor detects the user tearing a previously-dispensed towel from the dispenser. The sheet product dispenser also includes a cutting device, commonly referred to as a tear bar, positioned adjacent to the opening where the sheet product is dispensed. The tear bar allows a user to remove a portion of the sheet product roll from the dispenser.

Returning to FIG. 1, inventive features present in various embodiments of the roll support system 100 will now be discussed in more detail. Embodiments of the roll support system 100 include one or more lockout features that lock out some end caps, preventing the sheet product dispenser from dispensing properly when used with some end caps, while also allowing the sheet product dispenser to dispense properly when used with other end caps. More specifically, these lockout features allow arm 118 to rotatably support a sheet product roll 112 having a particular set of end caps, while preventing arm 118 from rotatably supporting other end caps, or rolls with no end cap at all. An end cap having a size and shape that interacts with one or more lockout features described herein is referred to herein as a matching end cap. An end cap having a size and shape that does not interact with the lockout features described herein is referred to herein as a locked-out end cap. Similarly, a sheet product roll without an end cap, or having an end cap of a size and shape that does not interact with the lockout features described herein, is a locked-out roll.

The aperture 127 disposed within the arm 118 of the roll support system 100 includes both a capture region 130 and a release region 133. The inclusion of these two regions within the aperture 127 in the manner disclosed herein provides one lockout feature by which a sheet product roll 112 having a matching end cap is rotatably supported by the arm 118. The structure and function of the capture region 130 and the release region 133 will be described in further detail below, but as can generally be seen in FIG. 1, the hub 121 of the end cap 103 is supported by the capture region 130 and does not enter the contiguous release region 133. As can also generally be envisioned by viewing FIG. 1, other locked-out end caps, having a different shape or dimension, will not be supported by the capture region 130 and will instead drop into the contiguous release region 133. The shape of release region 133 is such that a sheet product roll 112 does not freely rotate within the region.

Figure 2:
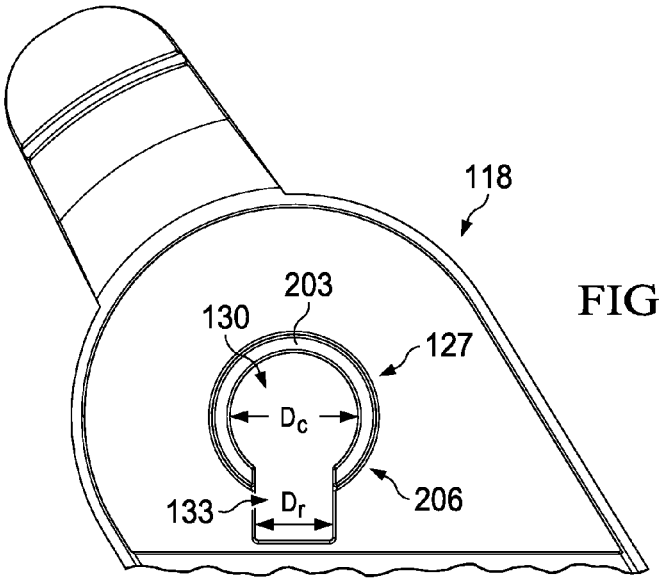
FIG. 2 is a front view of the end portion of the arm of FIG. 1, according to some embodiments disclosed herein.

The capture/release region lockout feature will now be explained more detail, starting with FIG. 2, which is a front view of the end portion of the arm 118. The aperture 127 extends through the arm 118 and is defined by a perimeter 203 encircling the aperture. The aperture 127 includes the capture region 130 and the release region 133. Also seen in FIG. 2 is an end view of a hollow protrusion 206 that surrounds a portion of the perimeter 203 of the aperture 127. The protrusion 206 is concentric with the central axis of the upper portion of the aperture 127. Since the hollow protrusion 206 surrounds the capture region 130, it has an inner diameter substantially equivalent to the diameter of the capture region 130. In the embodiment shown in FIG. 2, the hollow protrusion 206 is formed by a relatively thin wall defining an interior cavity. The protrusion 206 will be discussed in further detail below.

As discussed above in connection with FIG. 1, the aperture 127 is configured to receive the end cap 103 and the end cap 103 is in turn insertable into an end of the sheet product roll 112. Although the aperture 127 continues all the way through the arm 118 in the embodiments depicted herein, in other embodiments the aperture 127 is instead a recess into the arm 118, passing only partly through the arm 118.

Figure 3:
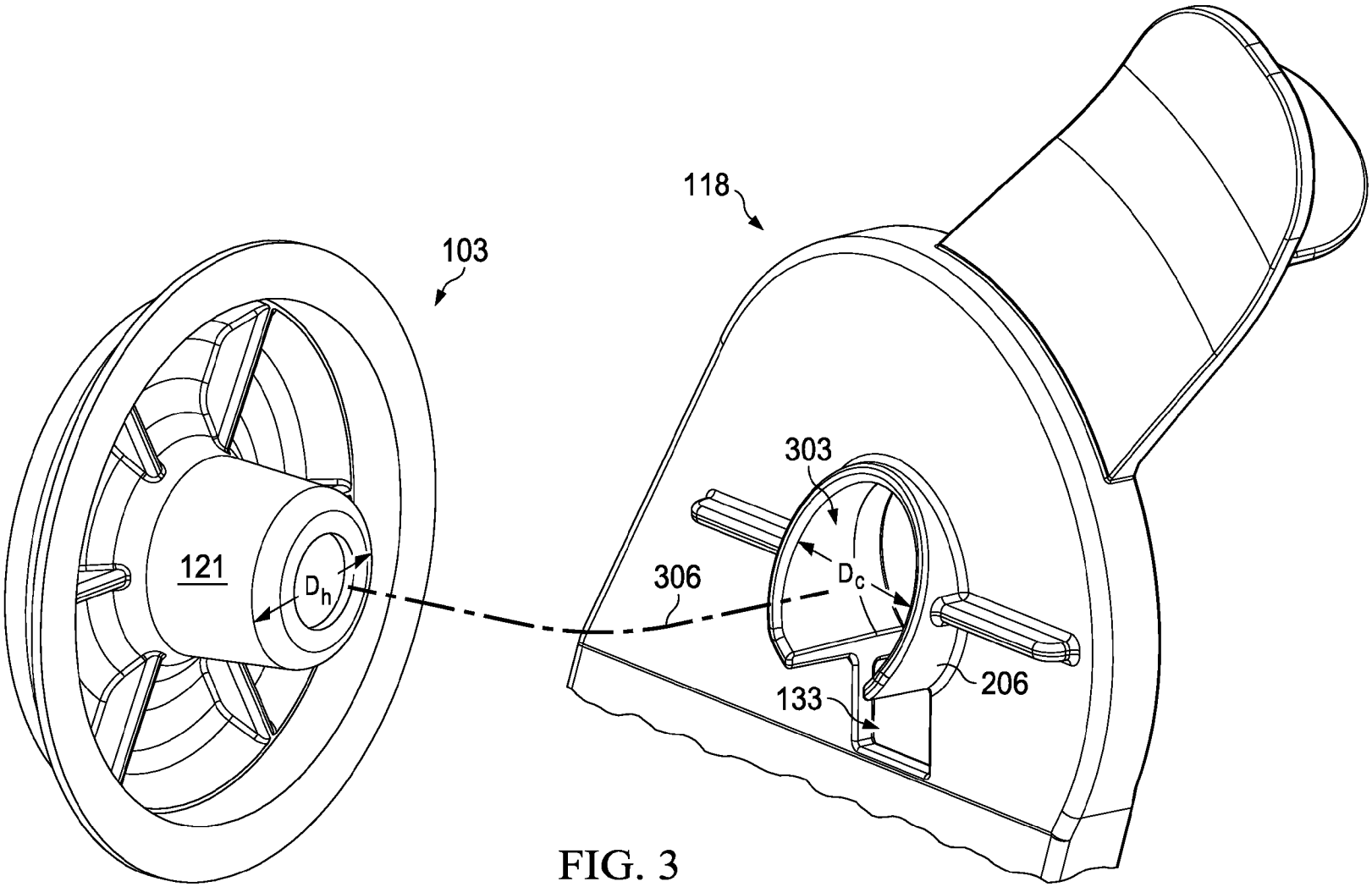
FIG. 3 is an isometric view of the inside surface of the arm of FIG. 1, along with the end cap of FIG. 1, according to some embodiments disclosed herein.

FIG. 3 is an isometric view of the inside surface of the arm 118, along with the end cap 103. Only the end portion of the arm 118 is visible in FIG. 3. Also visible in FIG. 3 is a guide channel 303 formed in the interior of the protrusion 206. The annular hub 121 enters the guide channel 303 of the protrusion 206 and supported by is at least a portion of the protrusion 206. In this embodiment, the guide channel 303 extends completely through the protrusion 206 to meet the aperture 127, so that one end of the guide channel 303 is contiguous with the capture region 130. In such embodiments, the hub 121 rests in the guide channel 303 and also in the capture region 130. In other embodiments, the guide channel extends only partially through the protrusion 206 and stops short of the aperture 127, but captures enough of the hub 121 to support the sheet product roll 112 that is attached to the hub end cap.

Notably, the aperture lockout feature described in connection with FIG. 3 is independent of the protrusion lockout feature described below. Other embodiments of the roll support system 100 do not include an aperture 127 in the arm 118. Instead of surrounding an aperture 127, the protrusion 206 extends from the solid inner surface of the arm 118. In one such embodiment, the guide channel 303 extends completely through the protrusion 206 and contacts the inner surface of the arm 118. In another of these embodiments, the guide channel 303 extends only partially through the protrusion 206 and stops short of the inner surface of the arm 118, but captures enough of the hub 121 to support the sheet product roll 112 that is attached to the end cap hub 121.

As best seen in FIG. 2, the capture region 130 has a generally circular shape, which allows the annular hub 121 to freely rotate within the capture region 130. The release region 133 is located below the capture region 130 and is contiguous with the capture region 130. The capture region 130 has a diameter, $D_c$, and the release region 133 has a diameter, $D_r$. As shown in FIG. 3, the hub 121 has an outer diameter $D_h$. Notably, $D_r<D_h<D_c$. As a result of this configuration, the end cap 103—as a matching end cap for the arm 118—is supported by and rotates within the capture region 130; notably, the smaller diameter of the release region 133 prevents the end cap 103 from entering the release region 133.

In contrast, a locked-out end cap with a hub outer diameter smaller than both $D_c$ and $D_r$ is able to enter the capture region 130, but will then fall through into the release region 133 as a result of gravity. A locked-out end cap with a hub disposed in the release region 133 generally interferes with rotation of the sheet product roll 112 because in such a configuration the sheet product roll 112 is mounted at an angle off the horizontal.

As noted above in connection with FIG. 1, a sheet product dispenser utilizing the roll support system 100 has a second arm (not shown) that supports the other end of the sheet product roll 112, for example, with a boss that engages the other end of the core 109 (FIG. 1). When operating as part of an assembled sheet product dispenser, the two support arms are horizontally aligned. More specifically, the capture region 130 is aligned horizontally with the boss (or whatever structure supports the other end of the sheet product roll 112). However, the release region 133 is at a lower point than the capture region 130. Therefore, a locked-out hub that drops through the capture region 130 and falls into the release region 133 causes one end of the sheet product roll 112 to be lower than the other. Generally, the sheet product dispenser is designed to operate properly when the sheet product roll 112 is horizontal. But because the locked-out end cap causes a non-horizontal alignment, a sheet product roll 112 using a locked-out end cap does not rotate freely within the aperture 127 of the arm 118.

More details of the protrusion 206 are also visible in FIG. 3. The protrusion 206 provides another lockout feature by which a sheet product roll 112 having a matching end cap is rotatably supported by the arm 118. The protrusion 206 extends from a surface of the arm 118. The protrusion 206 extends inwardly, that is, toward the end cap 103. The protrusion 206 is formed by a curved wall that defines a guide channel 303. As can generally be seen in FIG. 3, the hub 121 of the end cap 103 is sized and shaped to be received by the guide channel 303 formed in the protrusion 206, allowing movement of the hub 121 into the aperture 127. As can also generally be envisioned by viewing FIG. 3, other locked-out end caps, having a different shape or dimension, will not be received into the guide channel 303 and will instead travel down a ramped surface 306 of the protrusion 206. Thus, the ramped surface 306 prevents capture of the hub 121 by the arm 118 and ensures that a sheet product roll 112 using a locked-out end cap does not rotate about the arm 118.

Figure 5:
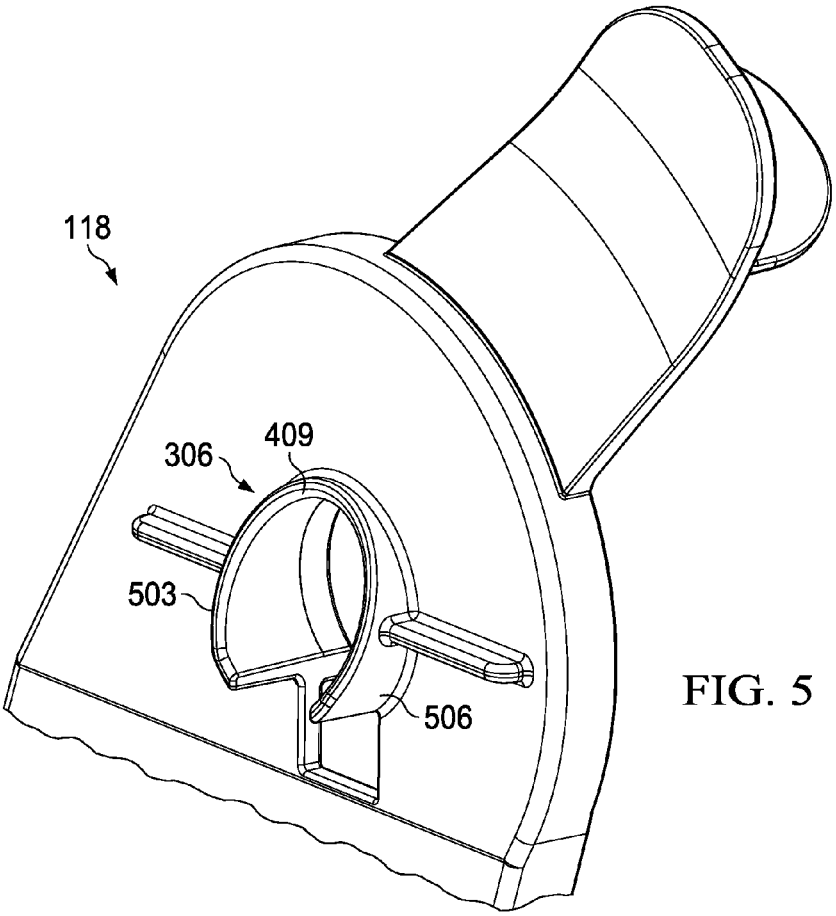
FIG. 5 is another isometric view of the end portion of the arm of FIG. 1, according to some embodiments disclosed herein.
Figure 4:
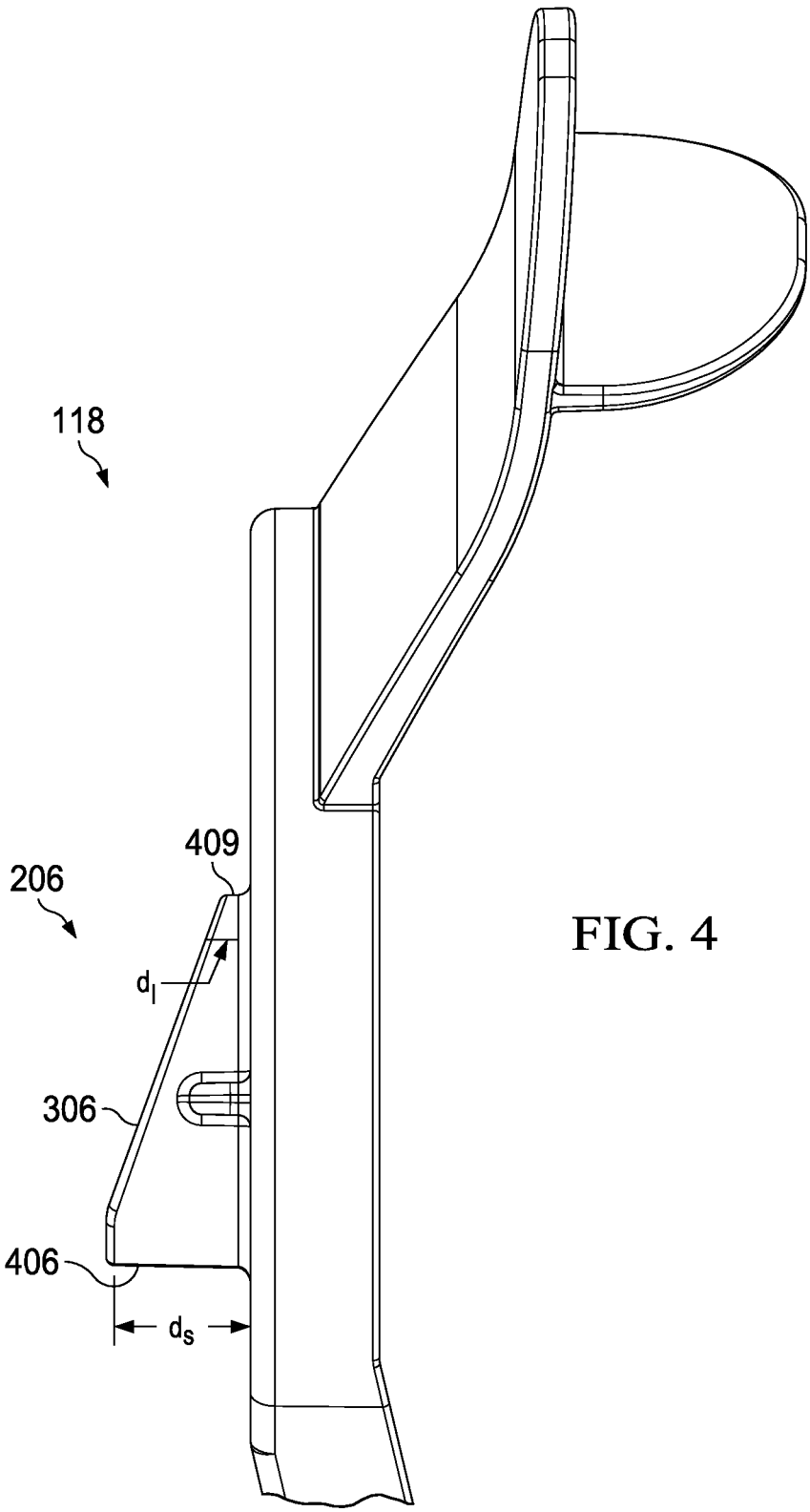
FIG. 4 is a side view of the end portion of the arm of FIG. 1, according to some embodiments disclosed herein.

FIG. 4 is a side view of the arm 118, depicting only the end portion. FIG. 5 is another isometric view of the arm 118, depicting only the end portion. As can be seen in both FIG. 4 and FIG. 5, the protrusion 206 extends away from the arm 118, in a transverse direction. As can best be seen in FIG. 5, the protrusion 206 ends at an end face 503. The protrusion 206 also extends downwardly along the surface of the arm 118, with a dimension that increases from top to bottom. The deepest portion of the protrusion 206, shelf 406, is thus at the bottom of the protrusion 206. The shallowest portion of the protrusion 206, lip 409, is thus at the top of the protrusion 206. The shelf 406 has a depth $d_s$ and the lip 409 has a depth $d_l$, where $d_l<d_s$. Because of this difference in depth, the end face 503 is also a ramped surface 306 that slopes downwardly with respect to the arm 118.

As best seen in FIG. 5, the end face 503 of the protrusion 206 forms an arc. Thus, the end face 503 is both curved and sloped or ramped. The arc does not form a complete circle, but is instead interrupted by the release region 133. The ramped surface 306 extends from one end of the arc, where the end face 503 meets one side of the release region 133 (left shelf 503 in FIG. 5), to the top of the arc (lip 409), to the other end of the arc, where the end face 503 meets one side of the release region 133 (right shelf 506 in FIG. 5).

Figure 6:
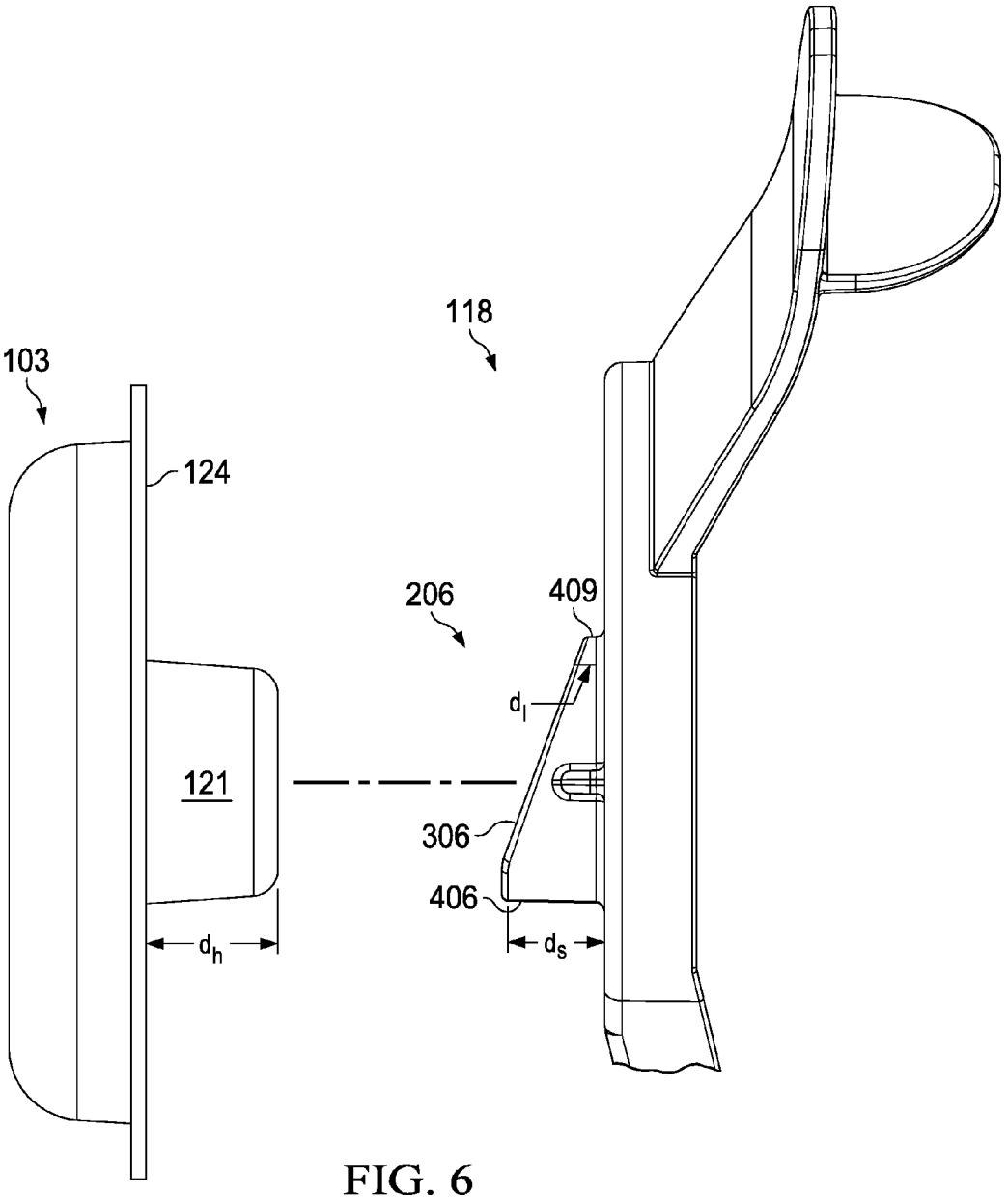
FIG. 6 is a side view of the arm of FIG. 1, along with the end cap of FIG. 1, according to some embodiments disclosed herein.

FIG. 6 is another side view of the arm 118, along with the end cap 103. Only the end portion of the arm 118 is visible in FIG. 6. The relatively narrow lip 409 (depth $d_s$) at the top of the protrusion 206 can be seen, as can the wider shelf 406 (depth $d_l$) at the bottom of the protrusion 206. The slope of the ramped surface 306 can be clearly seen in FIG. 6. In some embodiments, the slope has an angle of about 60° to 70°. The particular value of the slope angle is not critical, as long as a locked-out end cap is urged down the slope by gravity. This behavior will be explained in further detail below in connection with FIG. 6.

FIG. 6 illustrates another lockout feature present in some embodiments of the roll support system 100. In such embodiments, the hub 121—as part of a matching end cap for the arm 118—is has a depth $d_h$ that is greater than the depth $d_p$ of the shelf 406. Since the shelf 406 is the deepest part of protrusion 206, this means the hub 121 is completely passes through the protrusion 206 and engages the aperture 127. In particular, this means that the hub 121 is at least partially supported by the capture region 130 (not visible in FIG. 6), in addition to being supported by the protrusion 206.

In contrast, a locked-out end cap having a hub depth $d_h$ that is less than the depth $d_s$ of the shelf 406, would not be supported by the capture region 130. As such, the locked-out end cap would not properly rotate within the aperture 127. Without such support, the weight of the sheet product roll 112 (FIG. 1) attached to the locked-out end cap may cause the locked-out end cap to fall out of the guide channel 303. Depending on the mechanism used to keep the locked-out end cap in the end of the sheet product roll 112, this force may dislodge the locked-out end cap from the roll 112 (leaving the end cap in the guide channel 303), or the combined end cap and roll may fall away from the arm 118. In either case, the cooperation between the depth of the hub 121 and the depth of the guide channel 303 operates to impede the operation of the sheet product dispenser.

Returning now to FIG. 3, this figure illustrates how the ramped surface 306 of the protrusion 206 assists in insertion of a matching end cap 103 into the aperture 127. In some use scenarios, a user inserts a matching end cap 103 into the aperture 127 by inserting the end cap 103 into the guide channel 303 along the central axis 306 that is common to the guide channel 303 and the capture region 130. In such a scenario, with these parts aligned, the end cap 103 passes directly into the guide channel 303 (and on through to the capture region 130) without substantial contact with, or resistance from, the ramped surface 306. However, in other scenarios, the insertion path for the end cap 103 is off-axis with respect to the central axis 306. The design of the protrusion 206 allows the end cap 103 (and its attached sheet product roll 112) to be easily inserted from above. When inserted from above, the hub 121 will contact the ramped surface 306, and the slope of the ramped surface 306 allows gravity to urge the hub 121 downward along the slope. This downward force in turn urges the hub 121 and the guide channel 303, assuming the tolerances between the two parts is not too tight. Even if a tight fit doesn't allow the hub 121 to fall into the guide channel 303, the shelf 406 arrests the hub 121 at the end of the downward travel, allowing the user to easily push the hub 121 into the guide channel 303.

The same ramped surface 306 also provides another lockout feature which impedes a sheet product roll 112 having no end cap from operating properly with the roll support system 100. As noted above, a hub 121 inserted from above contacts the ramped surface 306, and the hub 121 is urged downward along the slope. As also noted above, a matching end cap 103 is likely to fall into the guide channel 303. However, without a hub, the sheet product roll 112 has no outward extension to guide it into the guide channel 303, and thus continues to travel down the slope. Some embodiments of the roll support system 100 include arm 118 that is flexible along its length, and/or is pivotally mounted at its bottom end. The weight of the sheet product roll 112 may be such that the top end of the arm 118 flexes or pivots outward as the sheet product roll 112 travels downward. The outward movement of the arm 118 causes the sheet product roll 112 to fall off the pair of arm supports and into the bottom of the dispenser housing.

Figure 8:
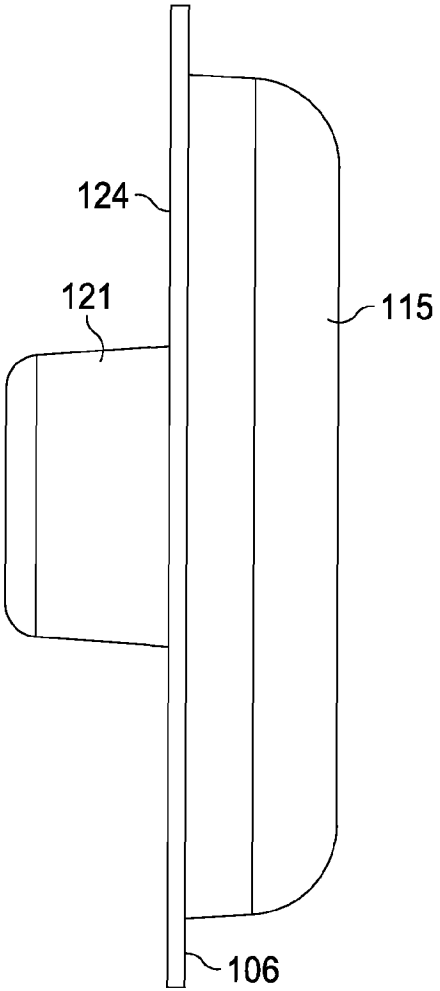
FIG. 8 is a side view of an end cap of FIG. 1, according to some embodiments disclosed herein.
Figure 7:
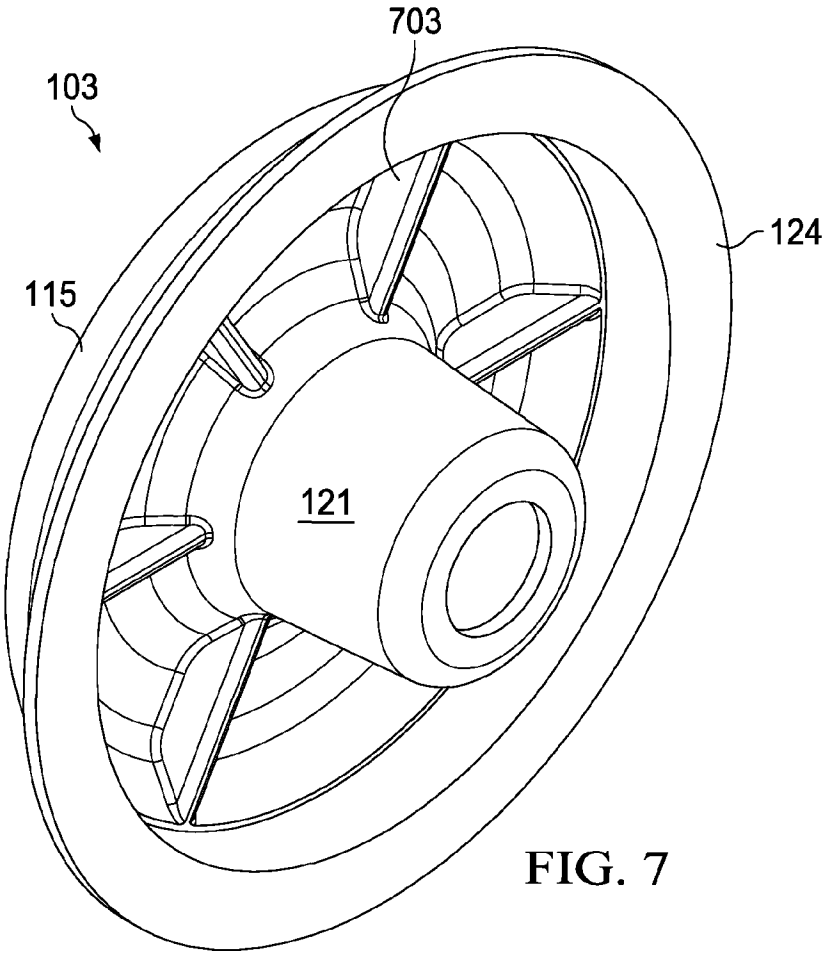
FIG. 7 is an isometric view of an end cap of FIG. 1, according to some embodiments disclosed herein.

FIGS. 7 and 8 are isometric and side views of one embodiment of an end cap 103 that cooperates with the arm 118 in a roll support system 100. Visible in these views are the inner surface 106, the flange 115, the outer surface 124, and the hub 121. This embodiment of the end cap 103 includes a set of fins 703 that increase the rigidity of the end cap 103, thus preventing the end cap 103 from dropping out of the sheet product roll 112. However, these fins 703 are not necessary to implement the lockout features described herein, and some embodiments do not include the fins 703.

What is claimed is:

1. A support for a sheet product roll, the support comprising:

an arm having an end portion;

an aperture formed in the arm proximate the end portion of the arm, the aperture including a capture region and a release region, the aperture forming an enclosed opening in the end portion of the arm, the capture region having a width dimensioned to receive a matching end cap and shaped to allow the matching end cap to rotate freely within the capture region;

the release region being contiguous with the capture region and having a width less than the width of the capture region.

2. The support of claim 1, wherein the capture region is generally circular and the release region is generally rectangular.

3. The support of claim 1, wherein the release region is disposed below the capture region.

4. The support of claim 1, further comprising a protrusion extending along at least a portion of a perimeter of the aperture, the protrusion extending away from the arm to an end face, and the end face forming a ramped surface that slopes downwardly with respect to the arm.

5. The support of claim 1, wherein the capture region defines a first portion of the aperture, the release region defines a second portion of the aperture, and the first portion and the second portion of the aperture extend through the end portion of the arm.

6. The support of claim 5, wherein the release region of the aperture is dimensioned and shaped such that the matching end cap does not rotate freely within the release region.

* * * * *